US006017258A

United States Patent [19]

Sakurai et al.

[11] Patent Number: 6,017,258

[45] Date of Patent: Jan. 25, 2000

[54] FILAMENT ATTACHING METHOD

[76] Inventors: Yumiko Sakurai, 28-17, Nakameguro 5-chome; Mari Nishibori, 3-4, Minami 1-chome, both of Meguro-ku, Tokyo 153, Japan

[21] Appl. No.: 08/963,858

[22] Filed: Nov. 4, 1997

[30] Foreign Application Priority Data

Nov. 6, 1996 [JP] Japan ..... 8-311354

[51] Int. Cl.[7] ..... H01K 3/06

[52] U.S. Cl. ..... 445/32

[58] Field of Search ..... 455/27, 32

[56] References Cited

U.S. PATENT DOCUMENTS 3,820,207 6/1974 Shanks ..... 445/32
3,904,908 9/1975 Wolfe et al. ..... 445/32
4,613,787 9/1986 Swain ..... 445/32
4,839,559 6/1989 Ahlgren et al. ..... 445/32
4,868,451 9/1989 Fields et al. ..... 445/32
5,008,592 4/1991 Pragt ..... 445/32

*Primary Examiner*—Kenneth J. Ramsey
*Attorney, Agent, or Firm*—Oblon, Spivak, McClelland, Maier & Neustadt, P.C.

[57] ABSTRACT

A method of attaching an extra fine filament of a halogen lamp. A support is fixed on an inner wall of an envelope. A mount having a filament is inserted into the envelope so that the filament is held by the support. The end of the envelope is heated and sealed so as to embed in the seal part of the mount in a sealing section formed on the end of the envelope.

5 Claims, 15 Drawing Sheets

FILAMENT ATTACHING METHOD

FIELD OF THE INVENTION

The present invention relates to a method of attaching an extra fine filament of a halogen lamp which directly uses a commercial power supply.

BACKGROUND OF THE INVENTION

In recent years, halogen lamps have been widely used suddenly, and they are being spread over various fields. In particular, as for domestic use, commercial power sources of 100 V, 120 V, 220 V and 240 V have been once lowered to a lower voltage of, for example, 12 V, by a transformer so that the halogen lamps have been used. In this case, there arose problems such that <1> the cost of the transformer is high, <2> according to the relationship of (dissipation power=voltage X electric current), when the commercial power-supply voltage is lowered to 12 V, in the same dissipation power, a current value becomes larger than the case where the commercial power-supply voltage is applied directly to a halogen lamp, and a trouble of contact with a socket, etc. easily occurs.

Therefore, it has been desired recently that a halogen lamp for general illumination at home including illumination at shops is shifted from the method of using the voltage which is lowered to 12 V to the method of directly using the commercial power-supply voltage. In this case, even if a special socket and light apparatus are not used, a halogen lamp can be used without using a transformer, etc. by thrusting or inserting it directly into a light apparatus to which a socket is attached.

However, in the case where lamps whose dissipation power is the same are compared with each other, a commercial power-supply voltage-type (100 to 240 V) halogen lamp has serious manufacturing and use problems in handing a filament because a diameter of the filament must be smaller and its length must be longer than a low-voltage-type halogen lamp whose lighting voltage is, for example, 12 V and 24 V.

These problems are such that: <1> since a filament is very thin, it is deformed during lighting and it easily causes sag, and since a filament is easily disconnected because of a vibration from the outside, a support is necessary; <2> since a diameter of the filament is small, it is very difficult to wind a support around the filament, and in the outrageous case, the filament is disconnected at the winding portion during the winding; and <3> the filament is frequently deformed and disconnected because of its thinness, so it is difficult to attach it to an envelope, and not only production using the hands but also mass production by automation are unthinkable.

BRIEF SUMMARY OF THE INVENTION

An envelope (1) in which a support (9) is arranged in the prescribed position is prepared.

Next, a mount (M) having a filament (6) is inserted into the envelope (1) so that the filament (6) in the mount (M) is held on the support, and an end of the envelope (1) is heated and sealed so that a part of the mount (M) is embedded and sealed in a sealing section (13) formed on the end of the envelope (1).

Therefore, unlike the conventional one, it is not necessary to previously attach the support (9) to the filament (6), so in the case where the extra fine filament (6) is used, the filament (6) can be held by the support (9). As a result, problems such as sag and earthquake-proof can be solved at a stroke.

The above and further objects and features of the invention will more fully be apparent from the following detailed description with accompanying drawings.

BRIEF DESCRIPTION OF THE SEVERAL VIEWS OF THE DRAWINGS

FIG. 1(*b*) is a front view, partially in section, of another example in the state that the stand-alone support is inserted into the both-end-opened-type envelope in the present invention;

FIG. 5(*b*) is a front sectional view of the halogen lamp in the case of a mount which does not use sealing foil;

FIG. 6(*b*) is an enlarged perspective view, partially in section, of the case where the support is fitted into and supported in a groove formed on the inner circumference of the envelope in the present invention;

FIG. 6(*c*) is an enlarged perspective view, partially in section, of the case where the support is fitted into and supported in a depression formed on the inner circumference of the envelope in the present invention;

FIG. 7(*b*) is a view, partially in perspective, of another example in the case where a plurality of supports are attached to the envelope at a time by using the support attaching jig;

FIG. 7(*c*) is a view, partially in perspective, of the case where a support continuous body is used;

FIG. 7(*d*) is a view, partially in perspective, of the case where a support attaching body is used;

DETAILED DESCRIPTION OF THE PREFERRED EMBODIMENTS

Figure 1A:
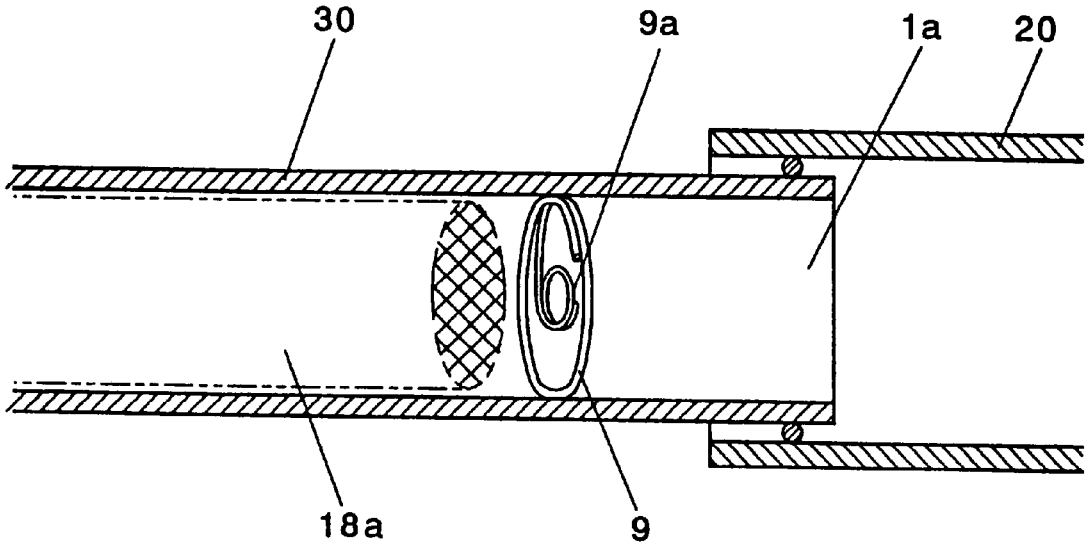
FIG. 1(*a*) is a front view, partially in section, of the state that a stand-alone support is inserted into a both-end-opened-type envelope in the present invention.

The following describes the present invention in detail according to the embodiments shown in the drawings. A halogen lamp (A) is a double-end type shown in FIGS. 5(*a*) and 5(*b*) and FIGS. 11 through 14. The double-end type halogen lamp (A) is a tipless type, but needless to say, the halogen lamp is not limited to this, so the present invention is applicable to a halogen lamp having a tip in which a conventional exhaust tube is used and a tip sealing-cut mark remains on the side of an envelope (1).

In the double-end type halogen lamp (A), a sealing section (13) is formed on both the ends of the envelope (1) made of quartz glass, and a filament (6) is stretched in an envelope main body (1H). The filament (6) is made of tungsten double coil, and a lead section (21) which is obtained by coating a single coil section of the filament (6) with a coil is formed on both the ends, and in FIG. 5(*a*) and FIGS. 11 through 14, the lead section (21) is welded to sealing foil (10).

The form of the lead section (21) is not limited to the aforementioned one, so the single coil section of the filament (6) may be welded directly to the sealing foil (10) or may be welded to the sealing foil (10) via an inner lead stick (not shown).

The sealing foil (10) is generally made of molybdenum with thin thickness of 20 to 30 $\mu$m, and at least a part or whole of it is embedded in the sealing section (13) formed on both the ends of the envelope main body (1H), and an outer lead stick (8) is welded to the other end of the sealing foil (10) so as to be projected outward from the sealing section (13). Under certain circumstances, the outer lead stick (8) is not used, and the sealing foil (10) may be projected directly outward from the sealing section (13).

In the present embodiment, a mount (M) is composed of the filament (6), sealing foil (10) which was welded to both the ends of the filament (6) via the lead sections (21) (may be formed directly at the ends, or formed via the inner lead stick), and the outer lead sticks (8) which were welded to the sealing foil (10) (not shown, or the outer lead stick (8) is not used and the sealing foil (10) may be projected directly from the sealing sections (13)).

Figure 5A:
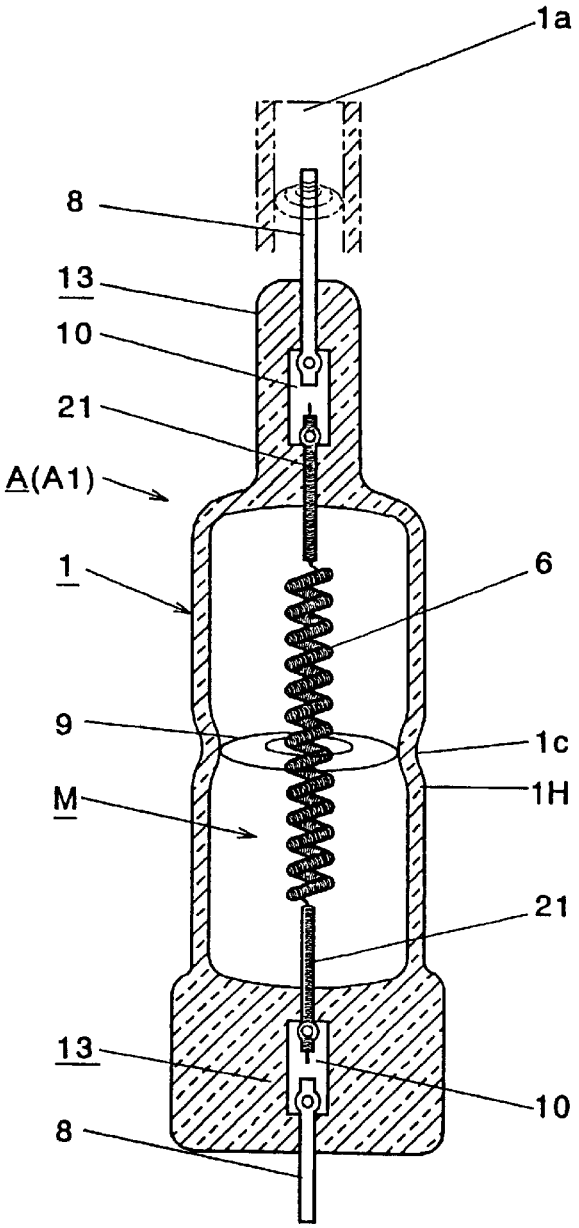
FIG. 5(*a*) is a front sectional view of the halogen lamp when both the ends of the envelope in FIG. 4 are sealed.
Figure 5B:
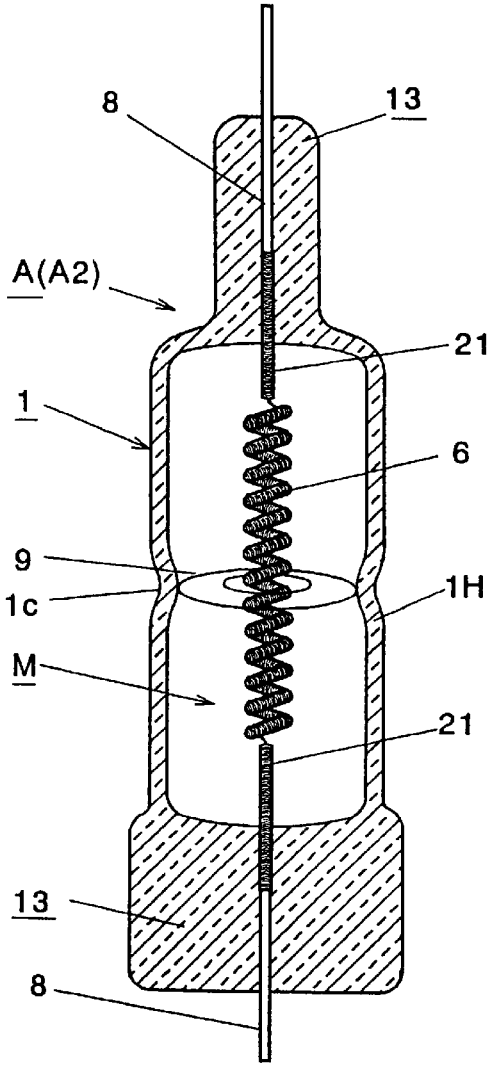

Another example of the mount (M) adopts a method without using the sealing foil (10), so the ends of the filament (6) are connected directly or via the lead sections (21) to the outer lead sticks (8). A halogen lamp (A2) which is produced by this method is shown in FIG. 5(*b*).

Namely, examples of combinations in the mount (M) are as follows:

<1> filament (6)+lead sections (21)+sealing foil (10)+outer lead sticks (8);

<2> filament (6)+lead sections (21)+sealing foil (10);

<3> filament (6)+sealing foil (10)+outer lead sticks (8);

<4> filament (6)+lead sections (21)+outer lead sticks (8);

<5> filament (6)+sealing foil (10); and

<6> filament (6)+outer lead sticks (8).

Figure 8:
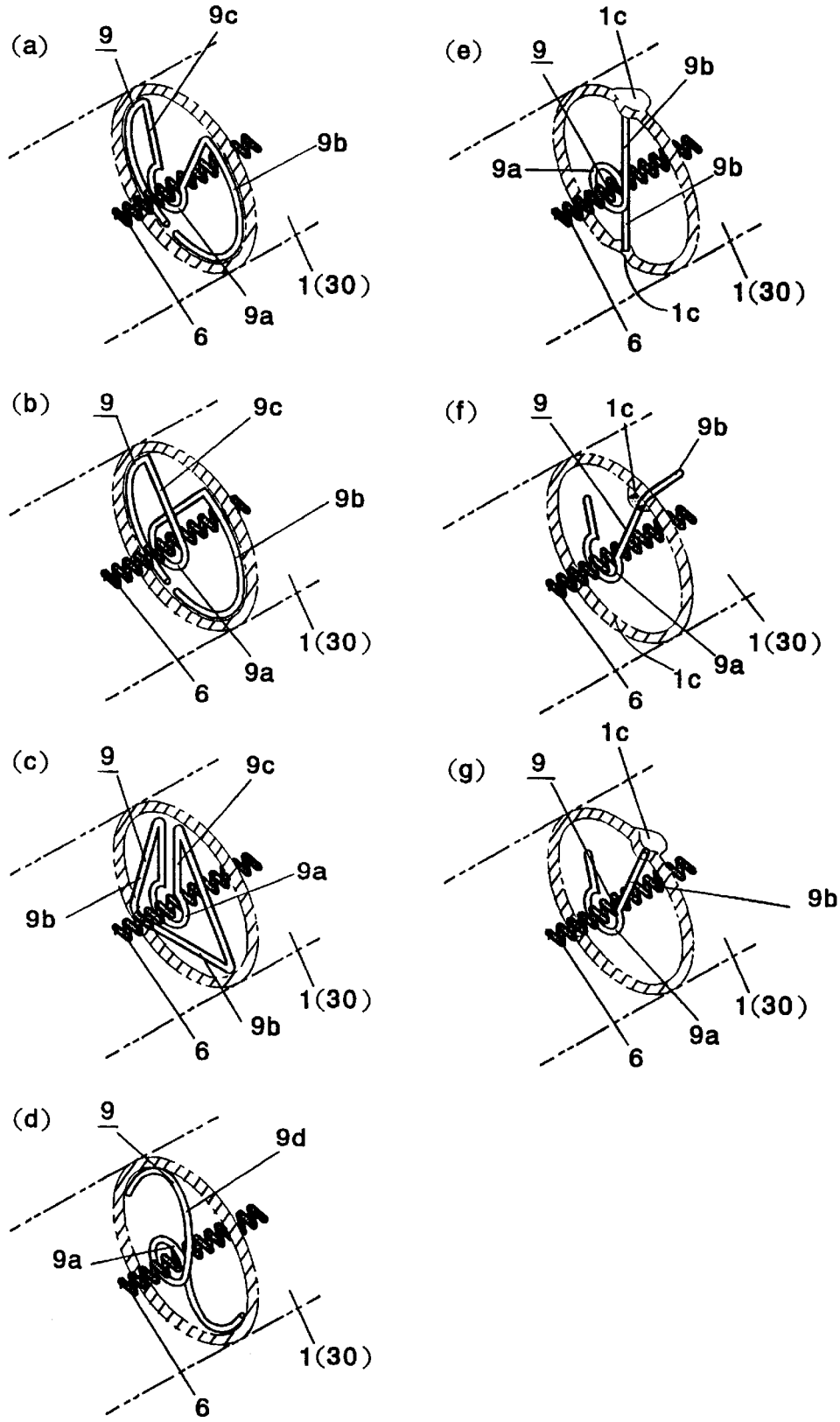
FIGS. 8(*a*) through 8(*g*) are views, partially in perspective, showing examples of various supports used in the present invention and examples of attaching them to the envelope.
Figure 10:
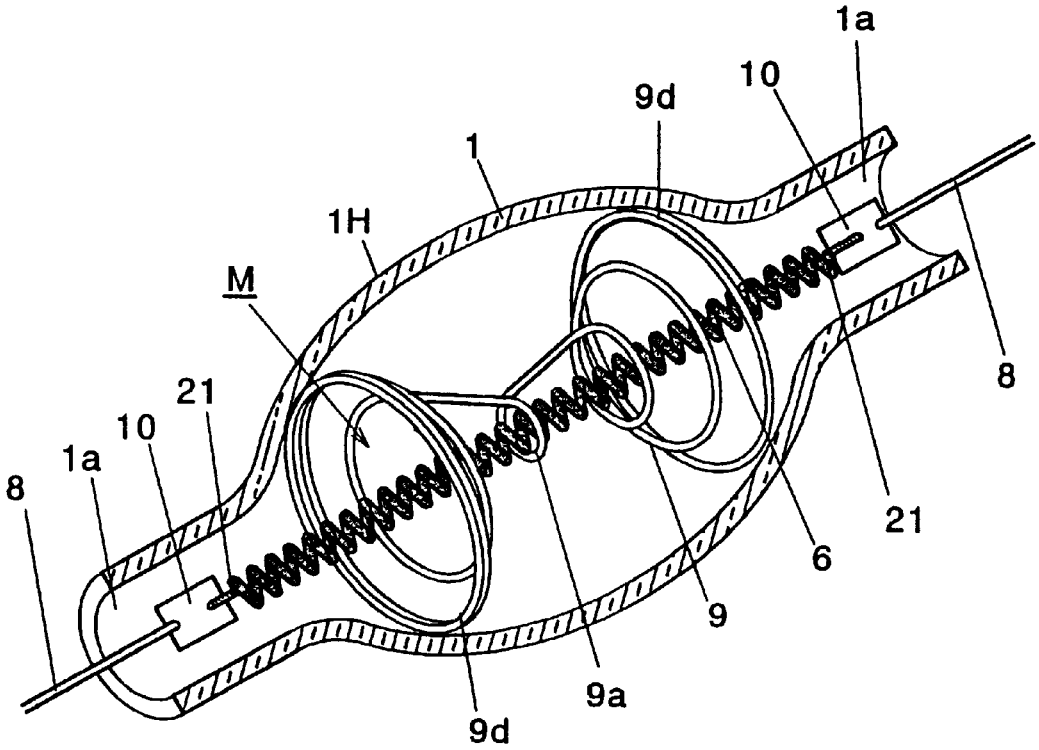
FIG. 10 is a perspective view showing an example that a double-spiral support is used in the present invention.

The following describes a support (9) on reference to FIGS. 8(*a*) through 8(*g*) and FIG. 10. The support (9) is means for holding the filament (6) along a center axis of the envelope (1), and its form is varied. Some examples of the shapes are shown. A material of the support (9) is a refractory metal stand-alone wire material such as tungsten, molybdenum, tantalum or rhenium, or a metal alloy wire material such as rhenium-tungsten.

The support (9) in FIG. 8(*a*) is composed of a ring-like filament holding section (9*a*) positioned at the center, linear sections (9*c*) led out from the filament holding section (9*a*), and semicircular leg sections (9*b*) led out from the linear section (9*c*). The leg sections (9*b*) elastically contact with the inner circumference of the envelope (1) so that the support (9) is supported in the envelope (1). However, instead of the attaching method such as elastic contact, for example, the leg sections (9*b*) can be attached to the inner circumference of the envelope (1) by a support attaching section (1*c*), mentioned later, and this is common among all kinds of the supports (9).

The support (9) in FIG. 8(*b*) is arranged so that the linear sections (9*c*) are led out from the ring-like filament holding section (9*a*) at the center to intersect each other, and the leg sections (9*b*) are led out from the linear sections (9*c*).

The support (9) in FIG. 8(*c*) is arranged so that the linear sections (9*c*) are led out from the ring-like filament holding section (9*a*) at the center, substantially V-shaped leg section (9*b*) is led out from one linear section (9*c*) and linear leg section (9*b*) is led out from the other linear section (9*c*). The whole shape is triangular, and its angular portions elastically contact with the inner circumference of the envelope (1).

The support (9) in FIG. 8(*d*) is arranged so that the arc-like leg sections (9*b*) are led out directly from the ring-like filament holding section (9*a*) so as to elastically contact with the inner circumference of the envelope (1).

The support (9) in FIG. 8(*e*) is a little different from the above four examples, so the linear leg sections (9*b*) are led out directly from the ring-like filament holding section (9*a*) so as to be attached to the inner circumference of the envelope (1) by the support attaching section (1*c*).

The support (9) in FIG. 8(*f*) is further a little different from the above examples, so the substantially L-shaped leg section (9*b*) is led out from the ring-like filament holding section (9*a*) so as to be attached to the inner circumference of the envelope (1) by the support attaching section (1*c*).

The support in FIG. 8(*g*) is similar to the one in FIG. 8(*f*), so the linear leg sections (9*b*) are led out directly from the ring-like filament holding section (9*a*), and one leg section (9*b*) is attached to the inner circumference of the envelope (1) by the support attaching section (1*c*).

FIGS. 8(*a*) through 8(*f*) show the examples of attaching the stand-alone support (9), but as to the attaching method of the support (9), there exist a method, mentioned later, of attaching stand-alone supports (9) one by one (see FIGS. 1(*a*) and 1(*b*)) and a method of attaching the supports (9) at a time using a continuous body (11) of the support (9), a support attaching jig (18*c*) or a support attaching body (15*a*) (see FIGS. 7(*c*) and 7(*d*)).

Figure 1B:
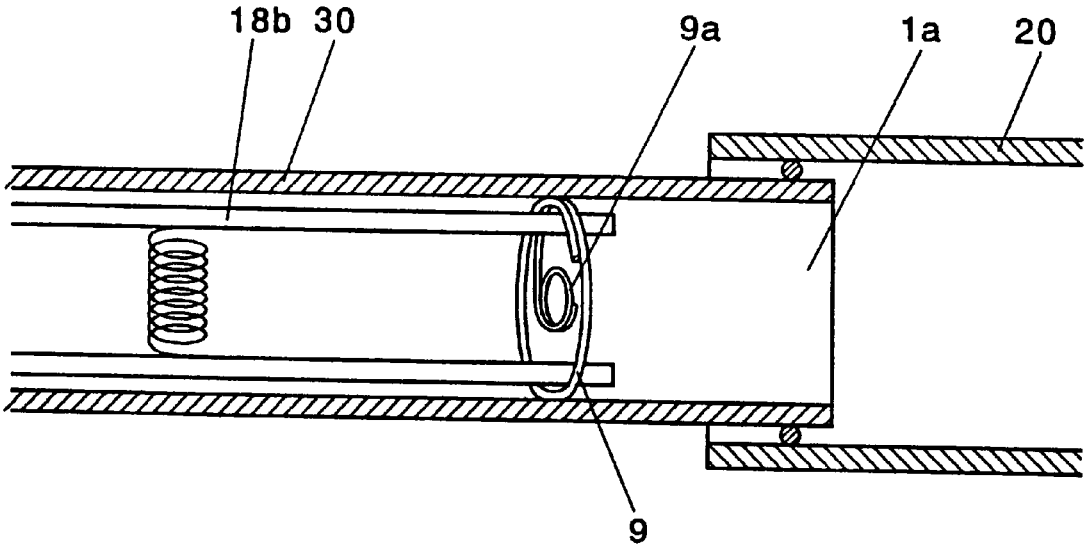
Figure 11:
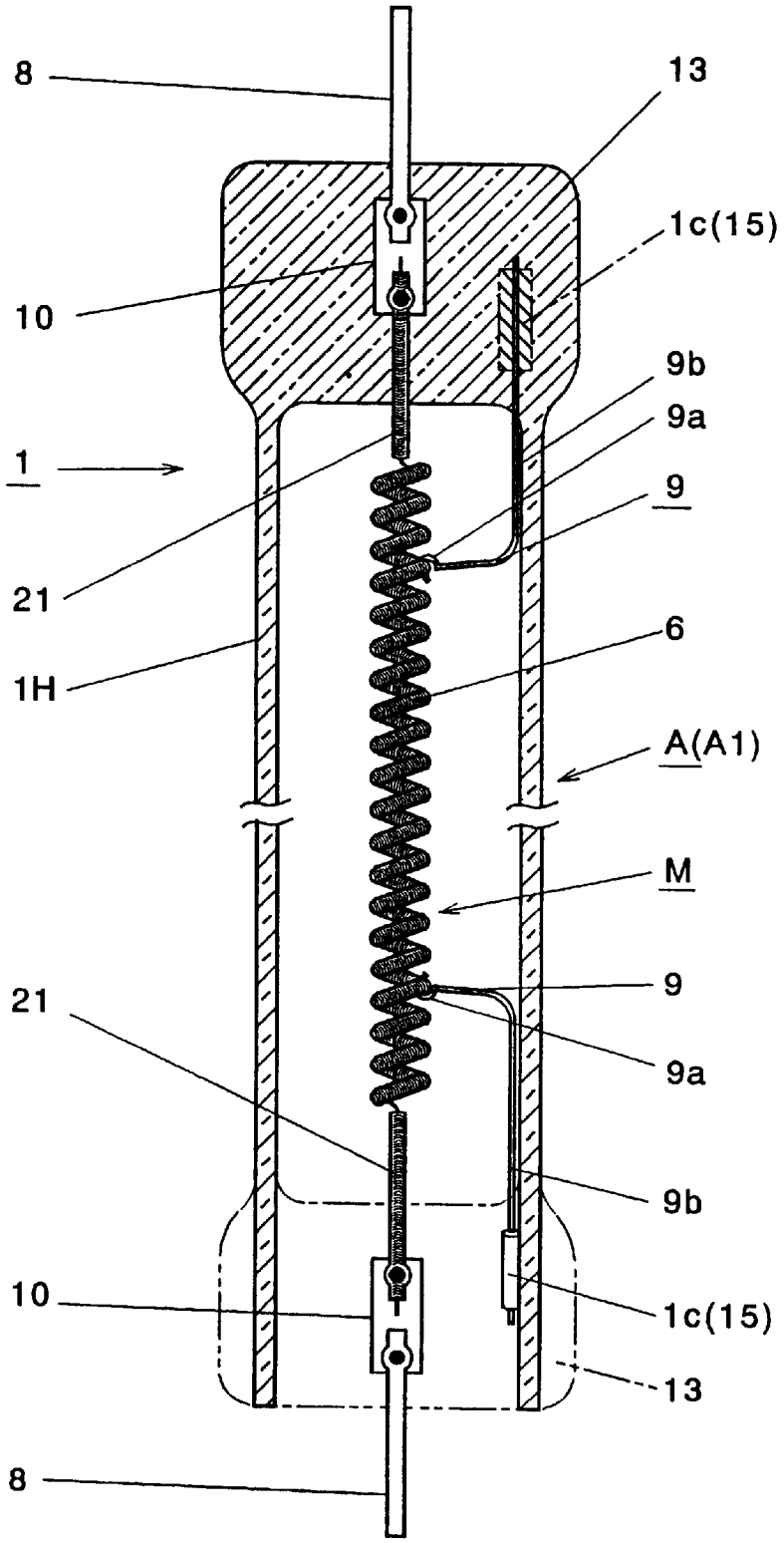
FIG. 11 is a sectional view showing an example of the halogen lamp formed by arranging a glass tube to the outside of the main body of the envelope in the present invention, lower half shows the state before sealing, and upper half shows the complete halogen lamp.
Figure 12:
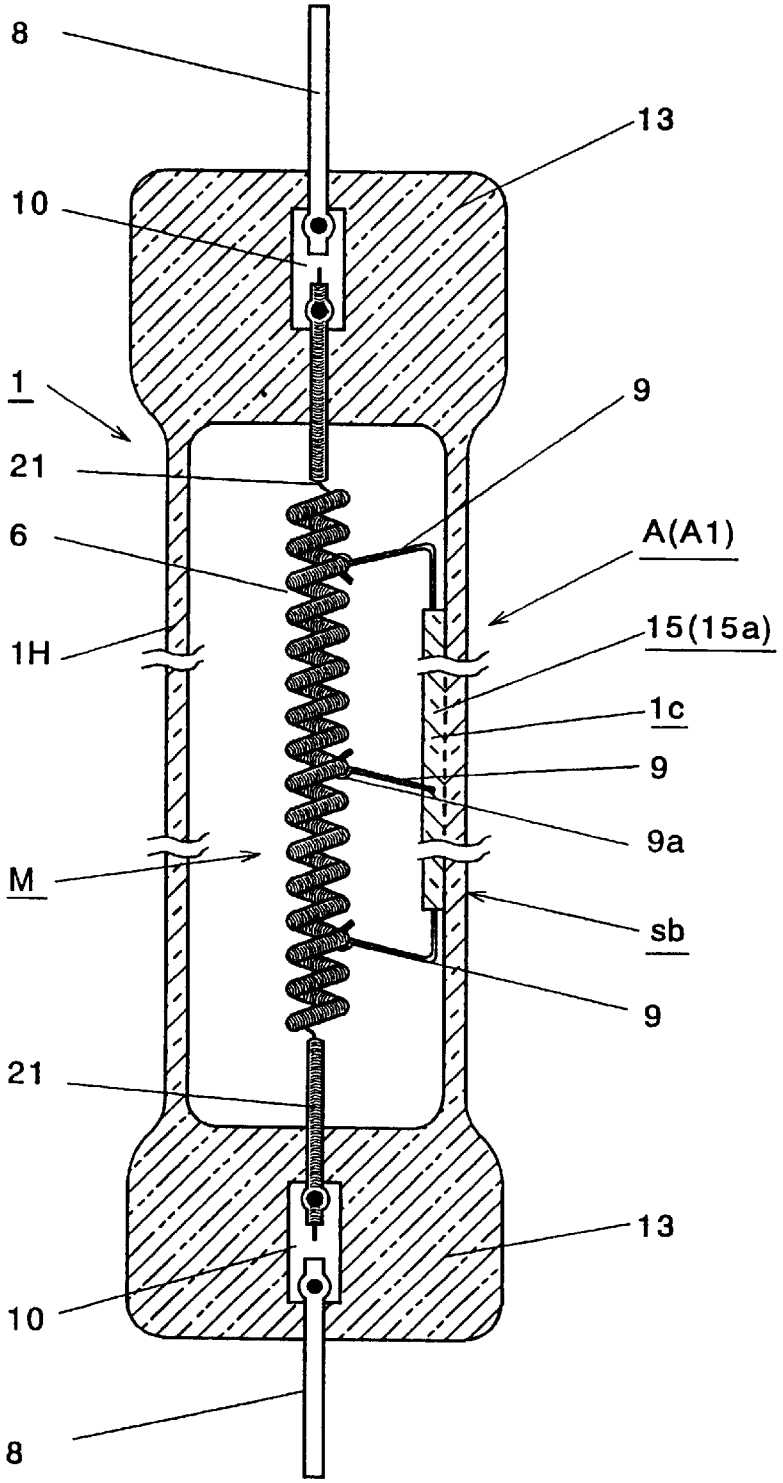
FIG. 12 is a front sectional view of the halogen lamp using the support attaching body in the present invention.

FIGS. 1(*a*) and 1(*b*) and FIG. 11 show the method of attaching the stand-alone supports (9) one by one, and FIG. 1(*a*) shows the method of inserting the stand-alone support (9) into a glass tube (30) composing the envelope (1) and pushing the stand-alone support (9) to a prescribed position using the support attaching jig (18*a*), and FIG. 1(*b*) shows the method of hooking the stand-alone support (9) on the tip of the support attaching jig (18*b*) like tweezers so as to setting it in a prescribed position.

Figure 6A:
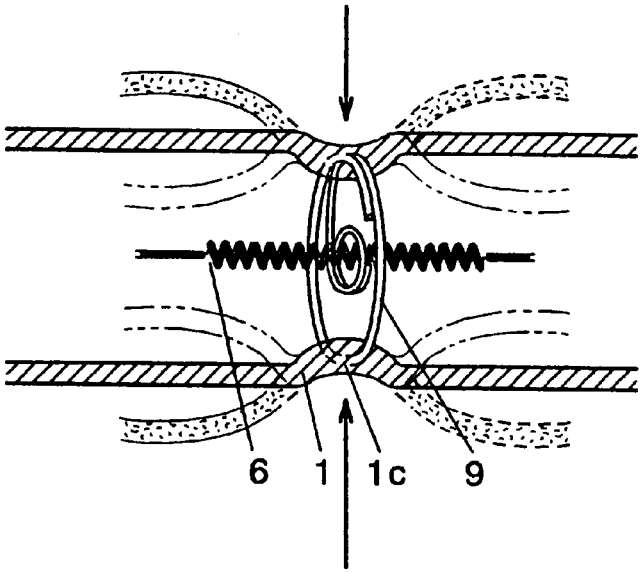
FIG. 6(*a*) is an enlarged perspective view, partially in section, of the case where a part of the support is embedded in an inner circumference of the envelope and supported in the present invention.
Figure 6B:
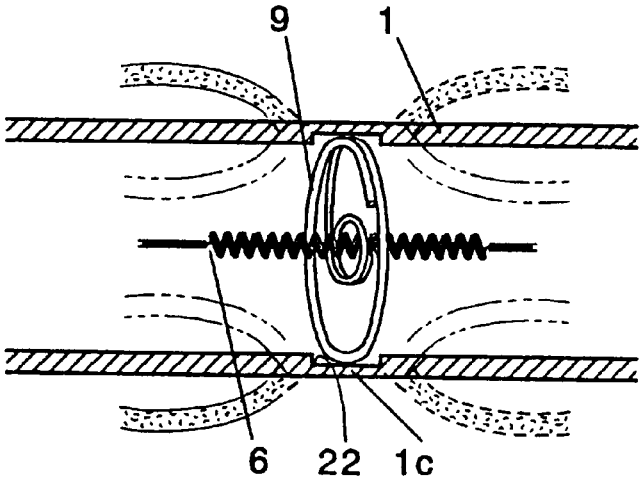
Figure 6C:
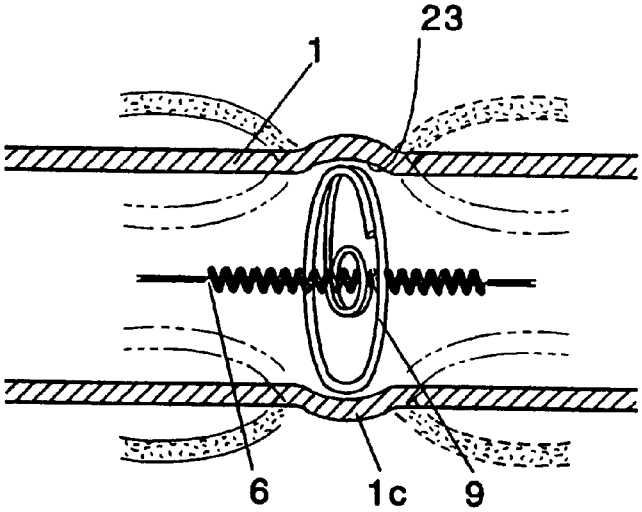
Figure 7A:
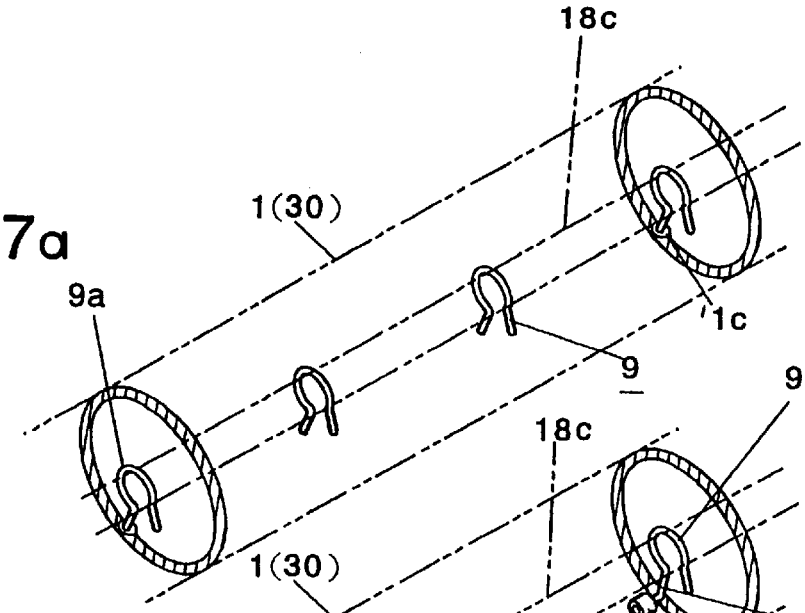
FIG. 7(*a*) is a view, partially in perspective, of one method of the present invention in the case where a plurality of supports are attached to the envelope at a time by using a support attaching jig.
Figure 7B:
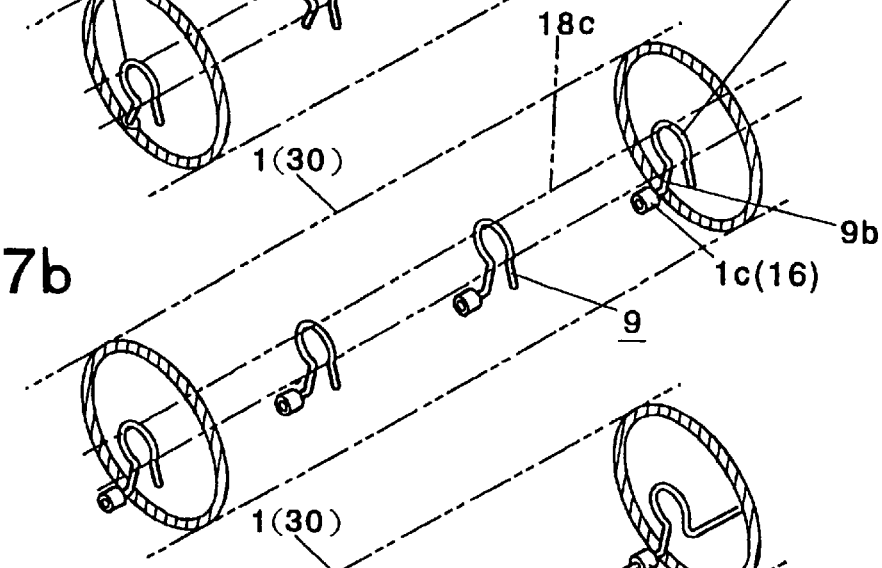
Figure 7C:
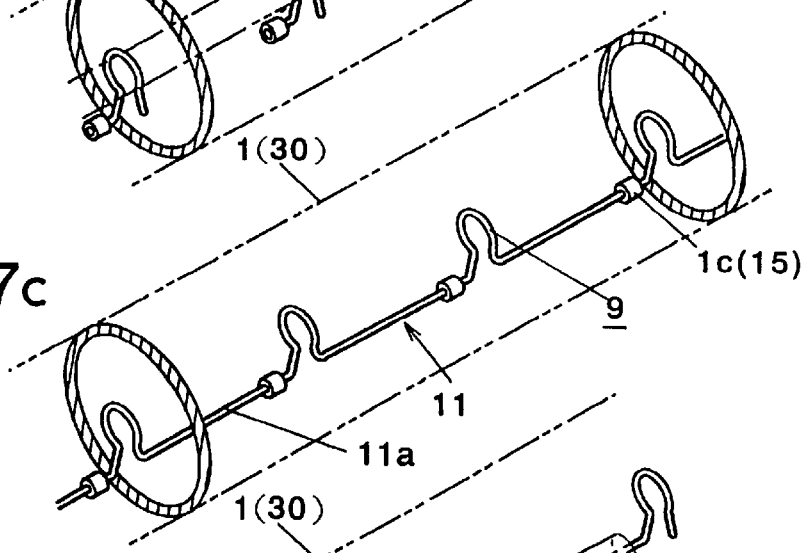
Figure 7D:
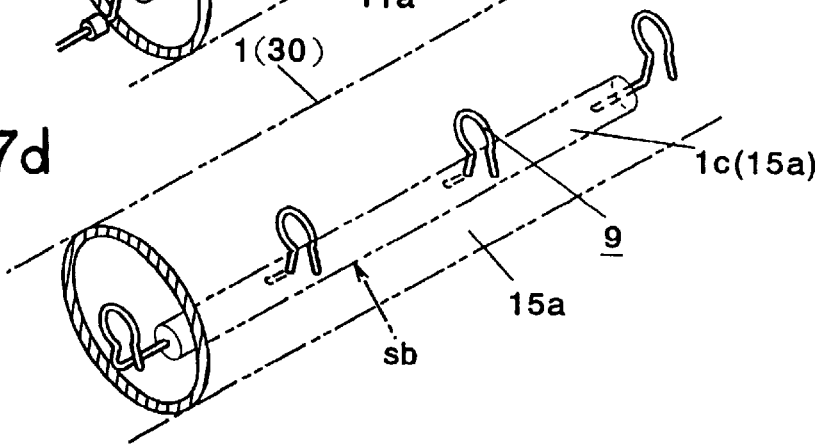

The following describes the relationship between the support (9) and the envelope (1):

<1> the support (9) is provided to the flat inner circumference, and the position of the support (9) is held by the elasticity of the support (9);

<2> as shown in FIG. 6(*a*), a part of the envelope (1) is spot-heated so as to be softened, and the softened part is pushed inside so that a portion of the support (9) is embedded in the pushed portion;

<3> as shown in FIG. 6(*b*), a prescribed position of the inner circumference of the envelope (1) is scraped off to a ring shape so that a groove (22) is formed, and the support (9) is fitted into the groove (22);

<4> as shown in FIG. 6(*c*), pressure in the envelope (1) is maintained higher than atmospheric pressure and at the same time a prescribed position is heated so as to be partially expanded in a ring-shape, and a depression (23) is formed on the inner circumference so that the support (9) is fitted into the depression;

<5> as shown in FIGS. 7(*b*) and 7(*c*), a glass bead (16) whose melting point is the same as or lower than that of the envelope (1) is attached to the leg section (9*b*) of the support (9), and the glass bead (16) is softened so as to be fused with the inner circumference of the envelope (1); and <6> a glass tube (15) whose melting point is the same as or lower than that of the envelope (1) is attached to the leg section (9*b*) of the support (9), and the glass tube (15) is softened so as to be fused with the inner circumference of the envelope (1). The spot-softened portion in which the part of the support (9) is embedded in <2>, the ring-like groove (22) in <3>, the depression (23) in <4>, the glass bead (15) whose melting point is the same as or lower than that of the envelope (1) in <5>, the glass tube (15) whose melting point is the same as or lower than that of the envelope (1) in <6> and the support attaching body (15*a*), mentioned later, are portions which serve as the support attaching section (1*c*).

Here, in the case where the envelope (1) is made of quartz glass, as the glass of the low melting point, aluminosilicate glass, borosilicate glass, etc. are generally used.

FIG. 11 shows another example of the attaching method of the support (9), and the lower half of the drawing shows an example that the leg section (9*b*) of the stand-alone support (9) is lengthened so as to be extended to the outside of the envelope main body (1H), and the glass tube (15) (glass bead (16) can be also used) is attached to the tip of the leg section (9*b*). In this case, when both the end sides of the envelope (1) are sealed, as shown in the upper half of the drawing, the glass tube (15) is also embedded in the sealing section (13) integrally. Needless to say, the attaching method of the stand-alone support (9) is not limited to the aforementioned ones.

The following describes an example that the individual supports (9) are attached at a time. FIGS. 7(*a*) and 7(*b*) show the methods using the support attaching jig (18*c*). First, the stand-alone supports (9) are attached to the support attaching jig (18*c*) at prescribed intervals. Any attaching method may be used, and in the drawing, the support attaching jig (18*c*) is pushed through the filament holding section (9*a*) of the stand-alone support (9), and the support (9) is supported so that the leg section (9*b*) hangs down. In FIG. 7(*a*), nothing is attached to the tip of the leg section (9*b*). In FIG. 7(*b*), the glass bead (16) or glass tube (15) which composes the support attaching section (1*c*) is attached to the tip of the leg section (9*b*), and the support attaching jig (18*c*) on which the stand-alone support (9) is hooked is inserted into the glass tube (30), the glass tube (30) is spot-heated in a non-oxidizing atmosphere, and the glass bead (16) or glass tube (15) is softened so as to be deposited on the inner circumference of the envelope (1). Therefore, the glass bead (16) or glass tube (15) whose melting point is the same as or lower than that of the glass tube (30) is used. Needless to say, as shown in FIG. 7(*a*), the glass bead (16) or glass tube (15) is not used, and as shown in FIG. 8(*g*), the glass tube (30) is spot-softened, and the tip of the leg section (9*b*) of the support (9) may be embedded in the softened portion. In this case, the portion which is spot-softened and depressed inside becomes the support attaching section (1*c*) as mentioned above.

The relationship between the support attaching jig (18*c*) and the filament holding section (9*a*) may be such that the support attaching jig (18*c*) is fitted into the filament holding section (9*a*) with clearance, or the support attaching jig (18*c*) may be temporarily fixed to the filament holding section (9*a*) so that an outside diameter of the support attaching jig (18*c*) becomes slightly larger than an inside diameter of the filament holding section (9*a*). In a word, the filament holding section (9*a*) may be held on the support attaching jig (18*c*).

FIG. 7(*c*) shows the case of using the continuous body (11) of the support (9), and shows the state that the leg sections (9*b*) of the supports (9) shown in FIG. 8(*f*) are connected to each other. The connected supports (9) are inserted into the glass tube (30), and the glass tube (30) is spot-heated in a non-oxidizing atmosphere so that the glass tube (15) attached to parts of the connecting portions (11*a*) to be the leg sections (9*b*) is softened and the glass tube (15) is deposited on the inner circumference of the envelope (1). Thereafter, parts of the connecting portions (11*a*) to which the glass tube (15) is not attached are laser-cut from the outside of the glass tube (30) so that the supports (9) are separated individually. The laser-cut may be performed at any time as long as the connecting body (11) has been attached to the glass tube (30), so the laser-cut may be performed, for example, <1> before the filament (6) is attached after the continuous body (11) has been attached to the glass tube (30), or <2> after the filament (6) has been attached.

In addition, the glass tube (30) may be spot-heated successively or at a time. Further, instead of the spot-heating, linear heating may be performed.

FIG. 7(*d*) shows the case of using the long-and-narrow stick-like or tubular support attaching body (15*a*), and a plurality of stand-alone supports (9) are mounted to the support attaching body (15*a*) so that a support block (Sb) is formed, and the support block (Sb) is deposited on the glass tube (30) as the envelope (1).

Here, in the specification, "mounting" is an idea showing the attaching methods such as "embedding" and "wind-mounting", and in this case, the ends of not less than one supports (9) are embedded in the support attaching body (15*a*) or wound around the outer circumference of the support attaching body (15*a*) (not shown).

Figure 13:
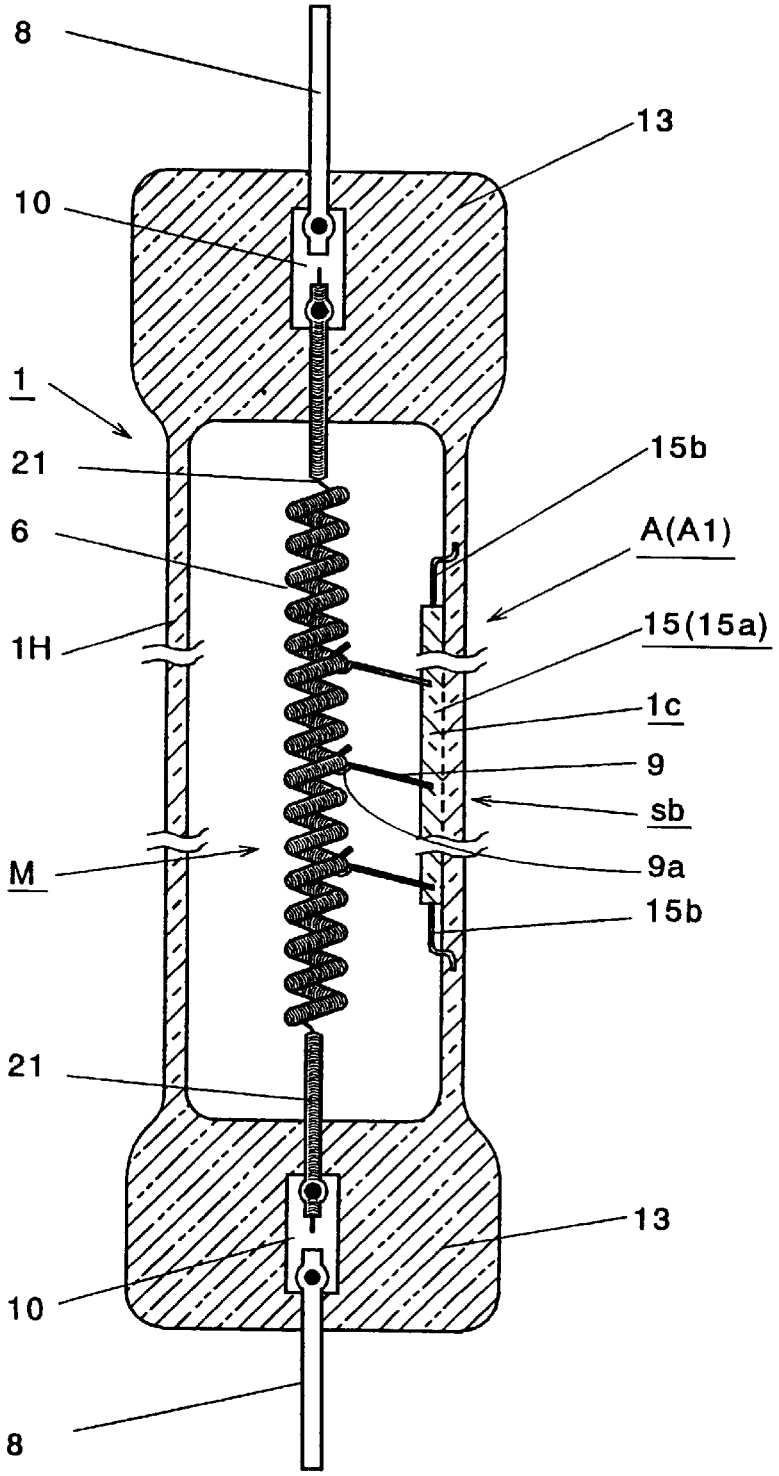
FIG. 13 is another front sectional view of the halogen lamp using the support attaching body in the present invention.
Figure 14:
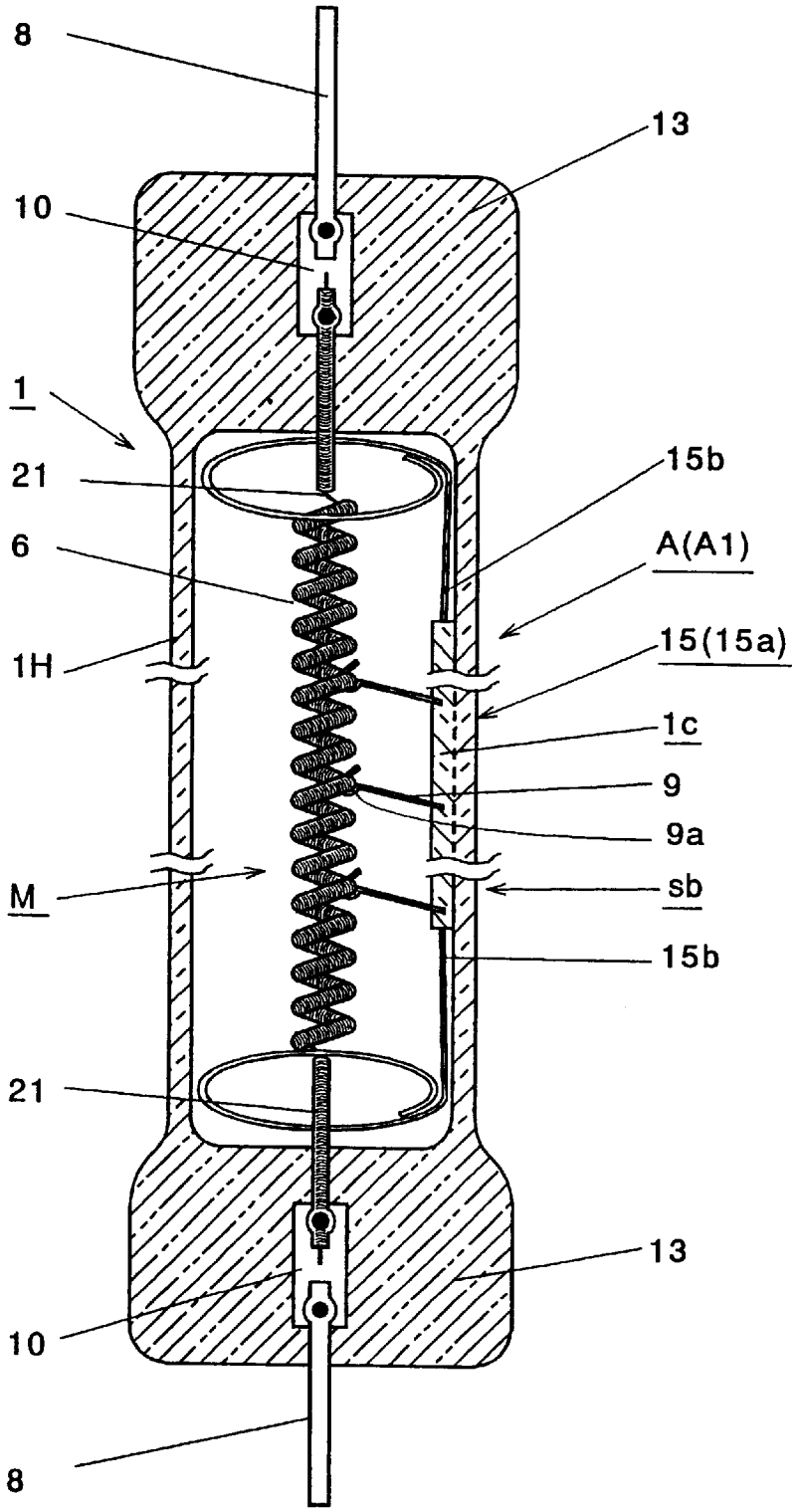
FIG. 14 is still another front sectional view of the halogen lamp using the support attaching body in the present invention.

In addition, as shown in FIGS. 13 and 14, the support (9) can be attached by using an attaching leg (15*b*) without depositing the support attaching body (15*a*) on the glass tube (30). This is effective in the support attaching body (15) made of ceramics which is not deposited on the envelope main body (1H).

Here, needless to say, the form of the support (9) is not limited to the aforementioned cases.

FIG. 10 is different from the aforementioned cases, so one wire material is wound spirally, and its both ends are thick diameter portions (9*d*). The diameter becomes smaller towards the inside, and its center portion is a thin diameter portion (9*a*). Therefore, in this case, the support (9) can be supported at two points, namely, at the thick diameter portions (9*d*) of both the ends. As shown in FIG. 10, the support (9) may be stored in the envelope (1) in which the envelope main body (1H) is rugby-ball-shaped, but needless to say, it may be stored also in the straight-tubular envelope (1). Here, in FIG. 10, when the support (9) is pushed into the envelope (1), the thick diameter portions (9*d*) are windingly tightened so as to be a narrow diameter, and the support (9) is inserted into a narrow opening (1*a*) of the envelope (1) and the support (9) is expanded therein so as to be supported at two points.

After the support (9) is attached into the glass tube (30) in such a manner, the mount (M) is inserted into the glass tube (30) in the same manner as the aforementioned one so that the filament (6) is attached to the support (9), and both the ends of the glass tube (30) are heated and sealed.

Next, in the present invention, the straight-tubular glass tube (3) is cut into a prescribed size so as to be used as the envelope (1), or the glass tube (3) is deformed and cut so as to be used as the envelope (1) with different form. These cases are described simply according to FIGS. 2(*a*) through 2(*g*).

Figures 2A, 2B, 2C, 2D, 2E, 2F, 2G:
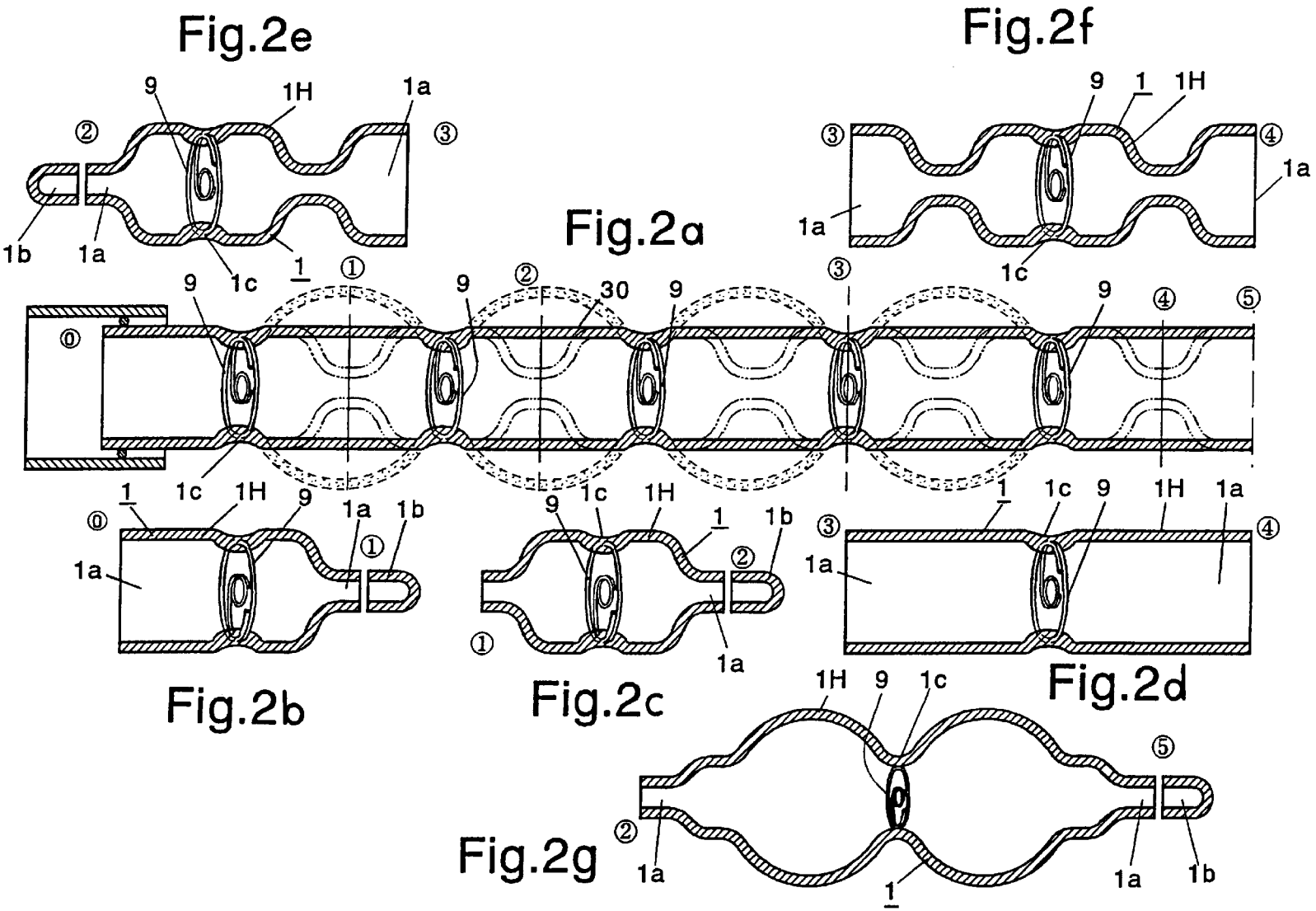
FIGS. 2(*a*) through 2(*g*) are front sectional views showing producing sequences of the envelope used in the present invention and showing various envelope.

The continuous lines in FIG. 2(*a*) show an example that a plurality of the stand-alone supports (9) are arranged in the straight-tubular glass tube (3) (arranged positions and intervals are arbitrary, so they are not limited to the embodiment in the drawing), the alternate long and two short dashes lines show an example that spaces between the stand-alone supports (9) are narrowed to be a small diameter, and the portions between chain lines which were dotted show an example that the spaces between the stand-alone supports (9) are expanded to a rugby-ball-shape. When the glass tubular (30) is cut appropriately, there exist examples such that one opening end (1*a*) is narrowed thinner than the envelope main body (1H) (FIG. 2(*b*)), that both opening ends (1*a*) are narrowed thinner than the envelope main body (1H) (FIG. 2(*c*)), that the opening ends (1*a*) are formed with the same size as the envelope main body (1H) (FIG. 2(*d*)), that one opening end (1*a*) is narrowed thinner than the envelope main body (1H) and the other opening end (1*a*) is composed of a small diameter portion and continuing large diameter portion (FIG. 2(*e*)), that both opening ends (1*a*) are composed of a small diameter portion which is narrowed thinner than the envelope main body (1H) and continuing large diameter portion (FIG. 2(*f*)), and that the envelope main body (1H) is expanded to a gourd-shape and both opening ends (1*a*) are narrowed (FIG. 2(*g*)). Needless to say, the present invention is not limited to these examples, so the opening ends (1*a*) of the envelope (1) are varied by appropriately combining the forms shown in the drawings. Moreover, one end may be a closed end (1*b*) as shown by hypothetical line instead of the opening end (1*a*).

The envelope (1) with the support (9) which was obtained in such a manner and the mount (M) (the drawings show the case of using the sealing foil (10), but the present invention is not limited to this as a matter of course, so the present invention is also applicable to the case of the mount (M) which does not use the sealing foil (10)) are prepared and they are assembled. One example of this is explained according to FIGS. 3 through 5(*a*).

In this case, the envelope (1), in which both ends are opened, the envelope main body (1H) is thick, a diameter of one opening end (1*a*) is small and the support (9) is previously attached inside, is prepared. The mount (M) using the sealing foil (10) is inserted into the envelope (1) from the opening end (1*a*) with small diameter so as to go through the filament holding section (9*a*) of the support (9) and is positioned in the envelope (1). Then, the sealing foil (10) is hooked on a narrow width portion x, which is obtained by slightly narrowing a base portion of the opening end (1*a*) with small diameter, and the mount (M) is suspended (the suspending method is not limited to this, so as shown by the hypothetical line, the mount (M) may be suspended from an elastic suspending member (3) which is wound around the outer lead stick (8)).

Figure 3:
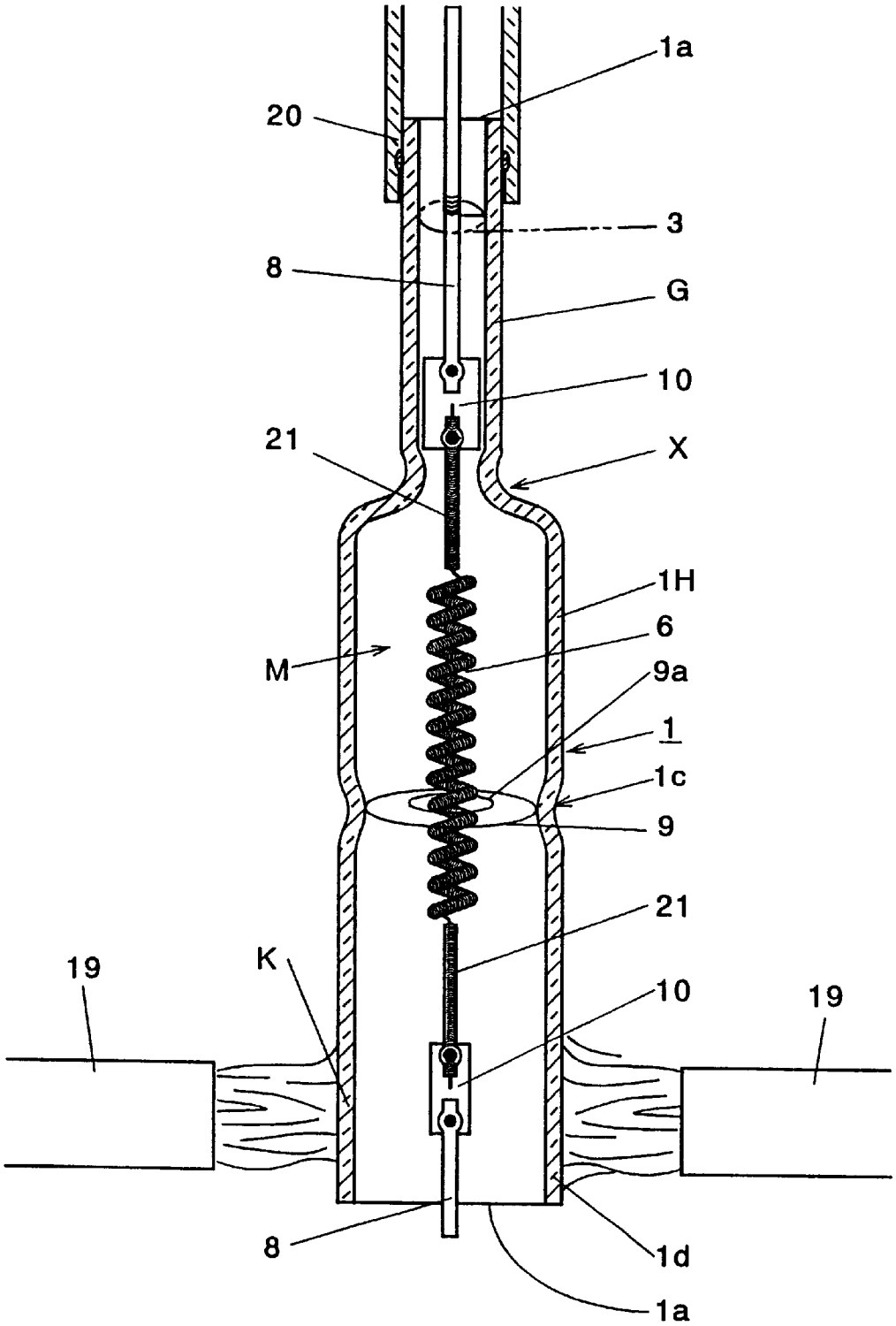
FIG. 3 is a front sectional view when one end of the envelope of the present invention is heated.
Figure 4:
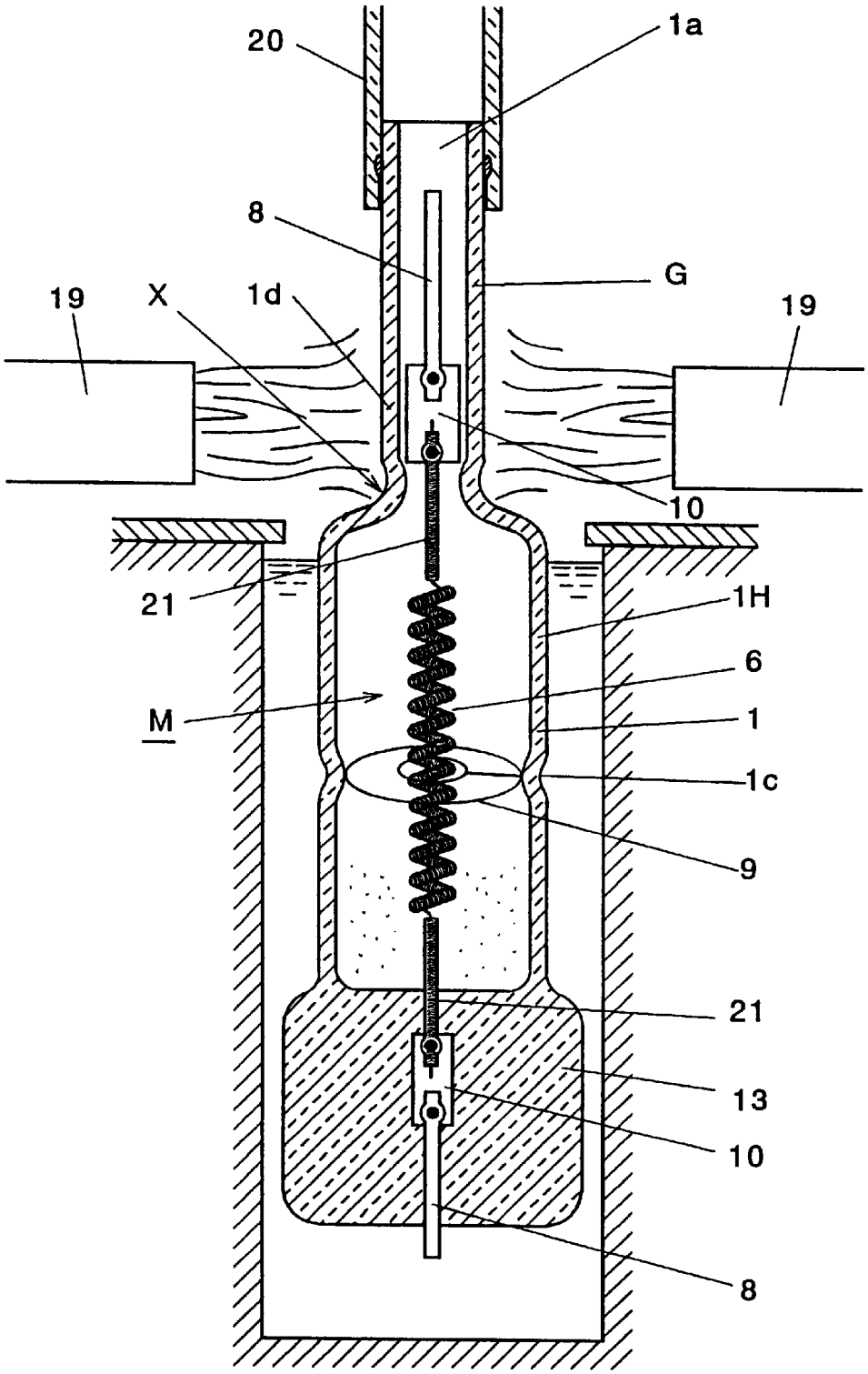
FIG. 4 is a front sectional view when the other end of the envelope in FIG. 3 is heated.

In FIG. 3, In this state, the opening end (1*a*) with small diameter shown by (G) is faced upwards so that the envelope (1) stands, a gas supply tube (20) is connected to the opening end (1*a*) so that non-oxidizing gas (inert gas such as nitrogen gas and argon, mixed non-oxidizing gas obtained by mixing reducing gas such as hydrogen with the inert gas) is blown into the envelope (1). Then, the non-oxidizing gas is made to spout from the lower opening end (1*a*) shown by a sign (K) so that the inside of the envelope (1) is maintained at a non-oxidizing state. Thereafter, a portion of the opening end (1*a*) below the mount (M) which contacts with the sealing foil (10) is heated to be softened.

The heated and softened portion (1*d*) is gradually shrank by the surface tension and heat of a burner (19) due to the heating and softening, and the heated and softened portion (1*d*) is pinched lightly or hard so that the lower opening end (1*a*) shown by the code (K) is sealed completely. This portion is the sealing section (13).

When the sealing of the lower opening end (1*a*) is completed, after the inside of the envelope (1) is subject to a necessary process such as washing by the non-oxidizing gas, the envelope (1) is filled up with necessary gas from the upper opening end (1*a*) represented by a code (G) from which the gas is supplied. While the most part of the envelope (1) including the lower sealing section (13) which has been sealed earlier is cooled by liquid nitrogen under certain circumstances, a portion of the upper opening end (1*a*) shown by a cord (G) which contacts with the sealing foil (10) is heated, and the heated portion (1*d*) is softened so that the sealing section (13) is formed (see FIG. 4).

When the sealing of both ends is completed, unnecessary portions of the opening ends (1*a*) are cut off as the need arises, and the halogen lamp (A1) in FIG. 5(*a*) is finished.

FIG. 5(*a*) is a sectional view of the halogen lamp (A1) formed by the aforementioned method, and the portion obtained by cutting off the unnecessary portion of one opening end (1*a*) is represented by a hypothetical line. Not only the halogen lamp (A1) having the form before cutting-off but also the halogen lamp (A) having the form after cutting-off can be used.

The above refers to the case where the sealing is performed in order, but the sealing is not limited to this, so it can be performed simultaneously.

Here, the pose of the envelope (1) at the sealing was described by illustrating the vertical pose, but the pose is not limited to this, so any other poses including horizontal and slanted poses are possible.

FIG. 5(*b*) shows a use example of the mount (M) that the filament (6) is connected directly to the outer lead stick (8) or connected via the lead section (21), and the material of the envelope (1) in this case is generally hard glass.

Here, in the case where the hard glass is used as the envelope (1), as shown in FIG. 5(*b*), the connecting portion between the filament (6) and the outer lead stick (8) or the lead section (21) is generally embedded in the sealing section (13), but the lead section (21) using the inner lead stick occasionally goes through the sealing section (13) so as to be projected to the outside of the sealing section (13), or the outer lead stick (8) occasionally goes through the sealing section (13) so as to be connected to the filament (6).

Figure 9:
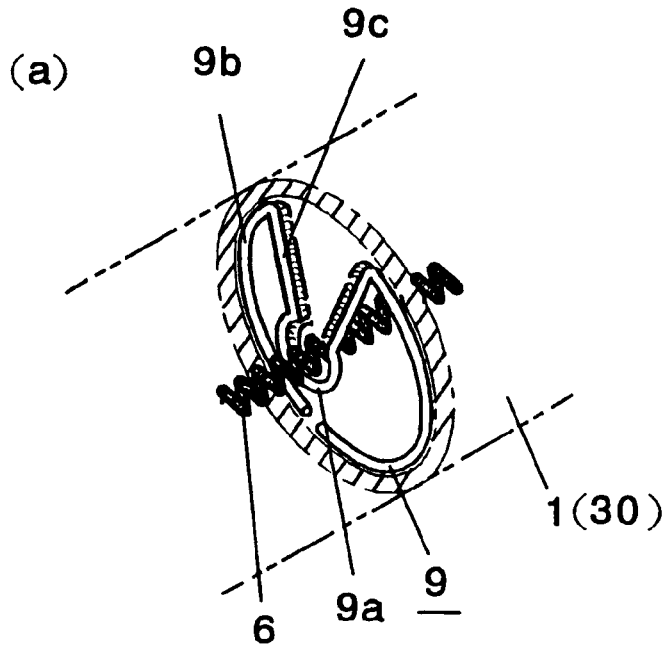
FIGS. 9(*a*) and 9(*b*) are views, partially in perspective, showing a relationship between the support and filament used in the present invention when the support is caulked.
Figure 9:
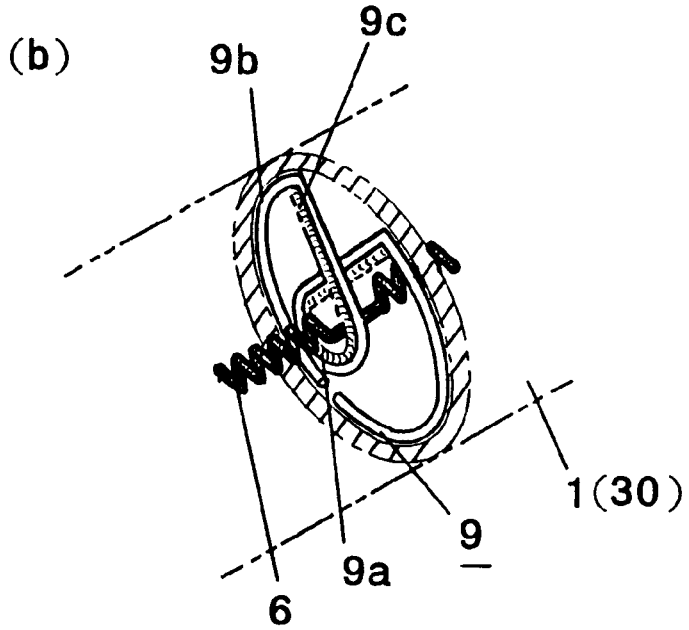

In addition, in the relationship between the mount (M) and the support (9), the filament (6) in the mount (M) may be simply pushed into the holding section (9*a*) of the support (9), but as shown by the hypothetical line of FIG. 9(*a*), the support (9) is caulked so that the diameter of the support holding section (9*a*) is made to be small, and thus the filament (6)is fitted into the support holding section (9*a*). Moreover, the fitted portion of the filament (6) may be, as shown in FIG. 9(*a*), a double-coil portion, or as shown in FIG. 9(*b*), a single-coil portion, or a wire portion, not shown, instead of the coil portion.

In addition, "caulking" can be performed as the need arises regardless of the form of the support holding section (9*a*).

In addition, the mount (M) is inserted into the ring-like support holding section (9*a*), or inserted into C-shaped support holding section (9*a*) from the break portion of the support holding section (9*a*) (FIGS. 11 through 14). In short, the mount inserting methods which agrees with the forms of the support (9) are adopted appropriately.

In addition, the present embodiment refers to the case of the tipless halogen lamp (A), but the present invention is not limited to this, so the present invention is applicable to conventional type halogen lamps using a exhaust tube.

Figure 15:
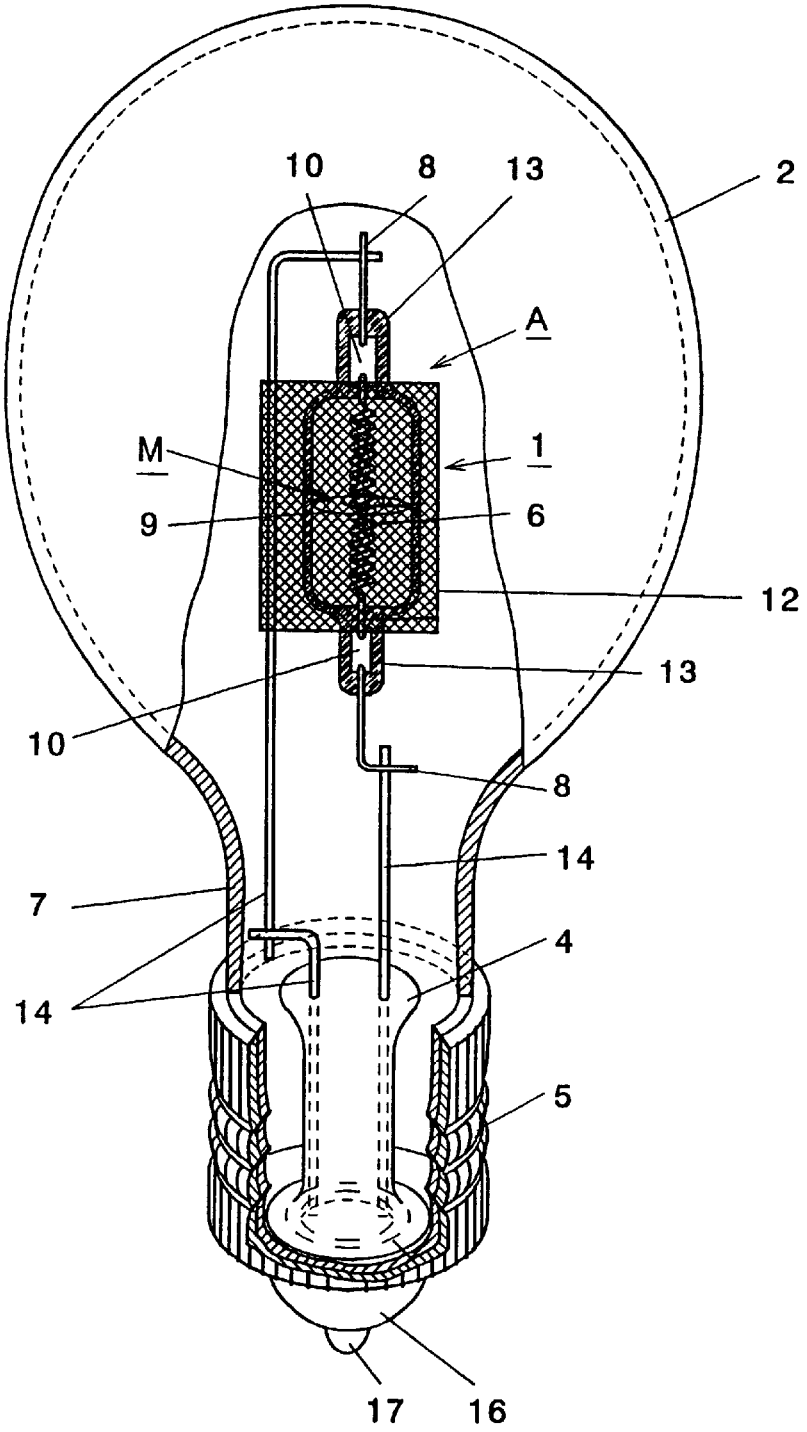
FIG. 15 is a partially cutaway view in perspective of a double explosion-proof lamp using the chipless halogen lamp in the present invention.

FIG. 15 shows the case where the halogen lamp (A) of the present invention is stood and is arranged in an outer bulb (2) for a general incandescent lamp. A stem (4) is attached integrally to the inside of a spirally cylindrical portion attaching section (7) of the outer bulb (2), and a spirally cylindrical portion (5) having the same size as a conventional eggplant-type general incandescent lamp is welded to the outside of the spirally cylindrical portion attaching section (7). A central contact (17) provided to the center of the spirally cylindrical portion (5) via an insulator (16) is connected to one lead stick (14) on the stem side generally via an intermediate lead-in wire. The other lead stick (14) on the stem side is connected to the spirally cylindrical portion (5) generally via an intermediate lead-in wire. As a result, the halogen lamp (A) can be mounted directly into a socket for the conventional eggplant-type general incandescent lamp.

The material of the outer bulb (2) may be glass or resin. Moreover, it may be a transparent material or semi-transparent material such as frosted glass, and an outer state of the outer bulb (2) can be selected arbitrarily. Moreover, its form is not particularly limited, so various forms including the aforementioned eggplant shape can be adopted.

The atmosphere in the outer bulb (2) is not particularly limited, so it may be non-oxidizing atmosphere by non-oxidizing gas, or a pressurized or pressure-reducing state, or the outer bulb (2) may be filled up with air.

In addition, an explosion-proof member (12) may be provided so as to surround the halogen lamp (A). As the explosion-proof member (12), for example, a cylindrical net obtained by braiding a thin wire, and punching metal and lath net which are obtained by rolled up cylindrically are considered. The explosion-proof member (12) is generally fixed to one of the lead sticks (14) directly or indirectly.

As a result, even if the halogen lamp (A) as the inner bulb is exploded for some reason, scattering of fragments can be prevented by the explosion-proof member (12), and thus a secondary accident due to the explosion can be prevented.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A filament attaching method comprising the steps of:

arranging a support having a filament holding section in a prescribed position of an envelope and fixing it on an inner wall of the envelope;

inserting a mount having a filament into the envelope so as to hold the filament in the mount in the filament holding section of the support; and heating and sealing an end of the envelope so as to embed and seal a part of the mount in a sealing section formed on the end of the envelope.

2. A filament attaching method comprising the steps of:

arranging a support block, which is obtained by mounting not less than one support having a filament holding section to a support attaching body composed of an insulating member, in a prescribed position of an envelope, and fixing the support attaching body on an inner wall of the envelope;

inserting a mount having a filament into the envelope so as to hold the filament in the mount in the filament holding section of the support; and heating and sealing an end of the envelope so as to embed and seal a part of the mount in a sealing section formed on the end of the envelope.

3. A filament attaching method in which a support continuous body that a plurality of supports having filament holding sections are continued is arranged in a prescribed position of an envelope and fixed on an inner wall of the envelope, a mount having a filament is inserted into the envelope so that the filament in the mount is held in the filament holding section of the support, and an end of the envelope is heated and sealed so that a part of the mount is embedded and sealed in a sealing section formed on the end of the envelope, said method comprising the step of cutting off connecting portions between the support of the support continuous body after the support continuous body is arranged in the envelope.

4. A filament attaching method comprising the steps of:

attaching not less than one support having leg sections to a support attaching jig; and hanging the leg sections down from the support attaching jig;

inserting the support attaching jig into an envelope so as to arrange the supports in prescribed positions of the envelope, and fix the tips of the leg sections of the support in the inner wall of the envelope;

after removing the support attaching jig from the supports, inserting a mount having a filament into the envelope so as to hold the filament in the mount in the support; and heating and sealing an end of the envelope so as to embed and seal a part of the mount in a sealing section formed on the end of the envelope.

5. A filament attaching method comprising the steps of:

attaching not less than one support having leg sections to a support attaching jig; and hanging the leg sections with the support attaching sections made of glass down from the support attaching jig;

inserting the support attaching jig into an envelope so as to arrange the supports in prescribed positions of the envelope, and fix the glass support attaching sections of the supports on the inner wall of the envelope;

after removing the support attaching jig from the supports, inserting a mount having a filament into the envelope so as to hold the filament in the mount in the support; and heating and sealing an end of the envelope so as to embed and seal a part of the mount in a sealing section formed on the end of the envelope.

* * * * *